US005762000A

United States Patent [19]

Detmers

[11] Patent Number: 5,762,000

[45] Date of Patent: Jun. 9, 1998

[54] DEVICE FOR CLEANING CYLINDRICAL SURFACES IN ROTARY PRINTING PRESSES

[75] Inventor: Andreas Detmers, Mauer, Germany

[73] Assignee: Heidelberger Druckmaschinen AG, Heidelberg, Germany

[21] Appl. No.: 647,468

[22] Filed: May 3, 1996

[30] Foreign Application Priority Data

May 3, 1995 [DE] Germany ..... 195 15 721.4

[51] Int. Cl.[6] ..... B41F 35/00

[52] U.S. Cl. ..... 101/424; 101/425

[58] Field of Search ..... 101/424, 423, 101/425; 15/256.5, 256.51, 256.52

[56] References Cited

U.S. PATENT DOCUMENTS

| | | | |
|---|---|---|---|
| 1,240,631 | 9/1917 | Trier | 101/425 |
| 4,537,130 | 8/1985 | Theilacker | 101/425 |
| 4,757,763 | 7/1988 | MacPhee et al. | 101/425 |
| 5,012,739 | 5/1991 | Loos et al. | 101/423 |
| 5,117,754 | 6/1992 | Nozaka et al. | 101/423 |
| 5,150,653 | 9/1992 | Hara | 101/425 |
| 5,404,819 | 4/1995 | Hishinuma et al. | 101/423 |

FOREIGN PATENT DOCUMENTS

| | | |
|---|---|---|
| 0119538 | 9/1984 | European Pat. Off. . |
| 0257818 | 3/1988 | European Pat. Off. . |
| 0414909 | 3/1991 | European Pat. Off. . |
| 0590195 | 4/1994 | European Pat. Off. . |
| 0446668 | 7/1994 | European Pat. Off. . |
| 0 636 476 A1 | 2/1995 | European Pat. Off. . |
| 88 09 032 U1 | 10/1988 | Germany . |
| 5-345409 | 12/1993 | Japan . |

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

Device for cleaning a rotating outer cylindrical surface, such as the surface of a printing-form cylinder, for example, in a printing press, with a cleaning-cloth web having edges oriented perpendicularly to the direction of generatrices of the outer cylindrical surface, including a cleaning-cloth web supply coil and a winding coil, the cleaning-cloth web being transportable from the supply coil to the winding coil, and a pressure element for pressing a section of the cleaning-cloth web against the outer cylindrical surface to be cleaned, further includes a holder extending in axial direction of the outer cylindrical surface and embracing the pressure element, the pressure element being disposed parallel to the rotational axis of the outer cylindrical surface, and a profile extending in the axial direction and covering the pressure element, the profile being provided with press-on material acting on the cleaning-cloth web from a side thereof opposite to the outer cylindrical surface.

13 Claims, 3 Drawing Sheets

DEVICE FOR CLEANING CYLINDRICAL SURFACES IN ROTARY PRINTING PRESSES

BACKGROUND OF THE INVENTION

Field of the Invention

The invention relates to a device for cleaning a cylindrical surface, more particularly, a rotating outer cylindrical surface in a printing press, for example, for cleaning the surface of a printing-form cylinder, with a cleaning-cloth web having edges oriented perpendicularly to the direction of generatrices of the outer cylindrical surface, and being transportable from a supply coil to a winding coil, a section of the cleaning-cloth web being pressed by means of a press-on or pressure element against the outer cylindrical surface to be cleaned.

The published European Patent Document EP 0 590 195 A1 discloses a device for cleaning printing-press cylinders or the like. A cleaning unit includes an exchangeable cartridge or cassette holding a supply of a cleaning cloth which is pressable by a pressure member against the surface to be cleaned, as the cleaning cloth is transported past that surface. The cassette with the cleaning-cloth supply is formed with a recess wherein a projection on the cleaning unit engages in order to -hold the cassette in a defined position on the printing unit.

The published European Patent Document EP 0 119 538 A2 relates to a squeegee for a roller-washing device. A squeegee for a washing device of a printing press has a profile tube which is disposed parallel to the roller to be squeegeed and is formed with a cross-sectional profile which is variable due to the application of pressure. The surface of the profile tube facing away from the roller is fastened to a rigid carrier or support. The surface of the profile tube facing away from the carrier or support is pressable against the roller due to the application of pressure.

The published European Patent Document EP 0 257 818 A2 discloses a cleaning system for a printing press. A sharp-edged blade presses a cleaning cover against the surface of a cylinder. In order to avoid a collision between the sharp-edged blade part and grippers on the circumference of the cylinder, the grippers are protected by cam parts. Moreover, a carrier whereon the blade part and the windable cover are carried is swingable away from the surface of the cylinder whenever the grippers of the cylinder pass the carrier.

The published European Patent Document EP 0 446 668 B1 discloses a cleaning device for a printing press. A diaphragm or membrane is provided therein having a diaphragm surface facing the outer cylindrical surface of a respective cylinder, the diaphragm surface bulging, i.e., being expansible, towards the outer cylindrical surface when it is subjected to pressure. The edges of a cleaning-cloth web extend perpendicularly to the direction of generatrices of the outer cylindrical surface. A section of the cleaning-cloth web is pressable against the outer cylindrical surface by the bulging or expanding diaphragm surface, which has a first surface region and a second surface region, the first office region being raised above the second surface region, so that the web edges extend outside the raised first surface region.

A squeegee device for a roller-cleaning device has become known heretofore from U.S. Pat. No. 4,537,130. A pressurizable hose is provided with a raised portion which, by pressurization of the hose, is bringable into contact with the surface to be cleaned. The hose is fastened to a rigid base.

The published European Patent Document EP 0 414 909 A1 discloses a cleaning device for ink form or plate inking rollers of a printing press. A covering is brought continuously or intermittently into contact with the surface of a roller to be cleaned, so that solubilized ink residues are absorbed by the covering. After a section of the covering has been saturated with ink, the section is conveyed or advanced farther over rollers, is cut off and thereafter disposed of. The covering includes at least one absorbing layer and at least one permeable layer which remove the solubilized ink from the surface of the roller being cleaned, and convey it away.

The outlined proposed solutions from the prior art exhibit some inherent disadvantages. The diaphragm pressing the cleaning cloth against the surface of the cylinder being cleaned is subjected to heavy loading by the cleaning cloth, which promotes wear and necessitates an undesirably frequent replacement or exchange of the diaphragm.

Because, for reasons of strength, the diaphragm has to be of relatively hard construction, it is no longer possible to compensate optimally for irregularities in the cleaning cloth. Because no mechanical travel limit is provided, the limit to travel is accomplished by limiting the pneumatic pressure. This, in turn, gives rise to a requirement for elaborate pressure-regulating devices. Moreover, the installation and sealing of the diaphragm is not simple, so that problems frequently arise leading to a complete failure of the washing unit, which is unacceptable.

Attempts to remedy the deficiencies have heretofore resided in the use of different cloths, optimizing the sealing of the diaphragm, and in the use of precise pneumatic pressure-regulating systems.

In view of the hereinafore outlined prior art as well as in view of the problems arising with the use of existing proposed solutions, it is an object of the invention to provide an improved device for cleaning surfaces of cylinders so that ink residues and also silicone residues, which are formed, for example, in a direct imaging of a printing form, are removable from the surface of a cylinder, and so that higher contact-pressure forces are realizable.

SUMMARY OF THE INVENTION

With the foregoing and other objects in view, there is provided, in accordance with the invention, a device for cleaning a rotating outer cylindrical surface, such as the surface of a printing-form cylinder, for example, in a printing press, with a cleaning-cloth web having edges oriented perpendicularly to the direction of generatices of the outer cylindrical surface, including a cleaning-cloth web supply coil and a winding coil, the cleaning-cloth web being transportable from the supply coil to the winding coil, and a pressure element for pressing a section of the cleaning-cloth web against the outer cylindrical surface to be cleaned, comprising a holder extending in axial direction of the outer cylindrical surface and embracing the pressure element, the pressure element being disposed parallel to the rotational axis of the outer cylindrical surface, and a profile extending in the axial direction and covering the pressure element, the profile being provided with press-on material acting on the cleaning-cloth web from a side thereof opposite to the outer cylindrical surface.

In accordance with another feature of the invention, the pressure element is enclosed substantially on three sides thereof.

In accordance with a further feature of the invention, the pressure element is a hollow body pressurizable with a pressure medium.

In accordance with an added feature of the invention, the profile is vertically movable and is guidable at side surfaces thereof by the holder.

In accordance with an additional feature of the invention, the profile is flexurally rigid.

In accordance with yet another feature of the invention, the profile has a guide bolt extending through the holder.

In accordance with yet a further feature of the invention, the guide bolt extends through the holder beyond a region thereof wherein the pressure element is disposed.

In accordance with yet an added feature of the invention, the device includes resetting elements provided on the guide bolt between the holder and the profile.

In accordance with yet an additional feature of the invention, the profile is movable along a travel path, and the guide bolt is formed with a stop surface for limiting travel of the profile.

In accordance with still another feature of the invention, the profile is provided with a supply of elastic press-on material.

In accordance with still a further feature of the invention, the profile and the holder are movable relative to one another when pressure is applied to the pressure element.

In accordance with a concomitant feature of the invention, the device includes a wetting device operatively associated with the cleaning-cloth web upstream from a location at which the press-on material acts upon the cleaning-cloth web, as viewed in a winding direction of the cleaning-cloth web.

The advantages associated with the foregoing constructions in accordance with the invention are of a manifold nature. Because the press-on or pressure element is not directly in contact with the cleaning cloth, there is no occurrence of mechanical wear nor wear caused by aggressive washing agents containing solvents for solubilizing silicone and other residues. The fact that the pressure element is embraced by the holder ensures the generation of a high press-on force, because the pressure or pressing-on element is able to expand only in a vertical direction. The separation of the pressure element from the press-on material which is being used permits the press-on material to be selected in accordance with optimal criteria.

As a further development of the gist of the invention, a travel limit is imposed on the profile covering the holder of the pressure element, this travel limit or stop effectively preventing the profile from dipping into the cylinder gap formed in the surface of the printing-form cylinder as the gap passes.

The use of a suitable material with elastic properties makes it possible to remove even obstinate residues from the surface of a cylinder, without having to fear the results of excessive wear on the cleaning cloth or on the press-on material.

In order to ensure the resetting movement of the profile, which covers the holder, from the surface of the cylinder being cleaned, springs are provided in the interior of the holder, for example, in the vicinity region of travel-limiting bolts.

Other features which are considered as characteristic for the invention are set forth in the appended claims.

Although the invention is illustrated and described herein as embodied in a device for cleaning cylindrical surfaces in rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
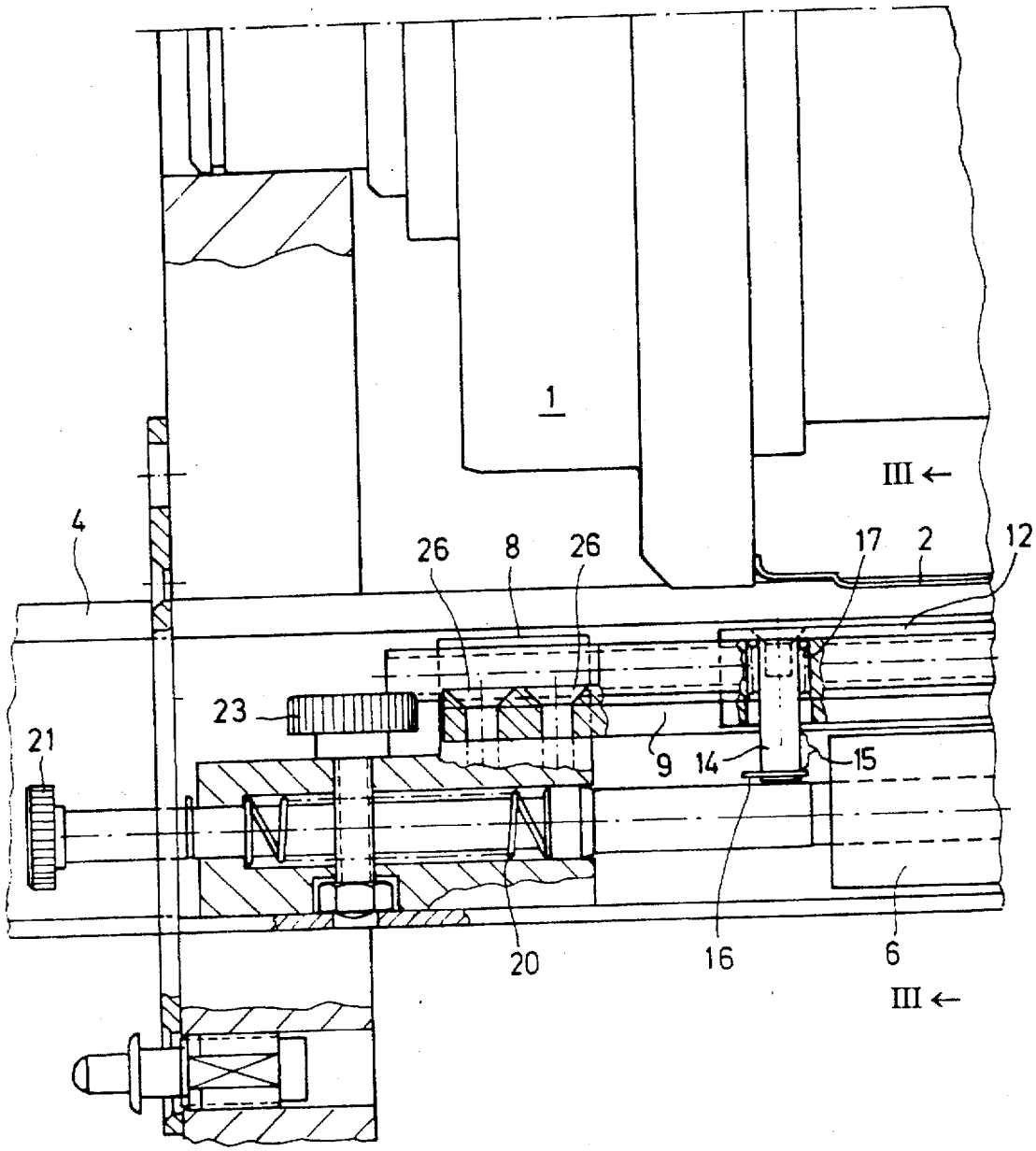
FIGS. 1 and 2 are half-sectional views of a cleaning device according to the invention, respectively, at the operating side and the drive side of a printing press.

Referring now to the drawings and, first, particularly to FIG. 1 thereof, there is shown therein, in a half-sectional view, a cleaning device according to the invention.

A printing-unit cylinder 1 having an outer cylindrical surface whereon a windable printing form, i.e., a printing foil, directly imageable within the printing press, is applied, is journalled in side walls of a printing press. A housing 4 is associated with the printing-unit cylinder 1 and contains a supply coil 5 and a winding coil 6 which transport a cleaning-cloth web 3 along the outer cylindrical surface 2 of the printing-unit cylinder 1. As is apparent from the half-sectional view of FIG. 1, the housing 4 accommodates an insert 8, to which there is bolted a holder 9, which, in turn, accommodates an axially extending pressure element 10, which is visible better in FIG. 3. Further provided on the insert 8 is a knurled screw 23, by which the insert 8 is bolted in the housing 4. Rotated 90° counterclockwise from the knurled screw 23 is a knob 21 which fixes a journal pin of a winding coil 6 by means of an axially extending spring 20. Disposed above a bearing arrangement for the winding coil 6 is a screw connector 26, by means of which the holder 9 which accommodates the pressure element 10 is locked at the insert 8. The holder 9, on the one hand, encloses a pressure element 10 which is able to be supplied with a pressure medium through an otherwise nonillustrated union and, on the other hand, serves as a guide for a profile 12 covering the holder 9 and having, by way of example, a U-shaped form. In order to ensure sufficient stiffness or rigidity of the arrangement across the format width, the holder 9 and the profile 12 are provided with U-shaped profiles. It is likewise possible, of course, to use rounded profile strips or half tubes or other profiles which ensure good flexural strength.

Attached to the profile 12 are guide bolts 14, which extend through the holder 9. At the lower end of the guide bolts 14 is a stop 16 which, by way of example, is in the form of a simple Seeger ring or circlip. Of course, the stop may also be of a different construction. When pressure is applied to the pressure element 10 inside the holder 9, it results in a vertically extending contacting movement of the profile 12 against the outer cylindrical surface 2 of the printing-unit cylinder 1. The vertical contacting movement is limited by the stops 16 provided on the guide bolts 14. This results in a maximum contacting range 15, which is so dimensioned that the profile 12 is prevented from dipping into a cylinder gap on the outer cylindrical surface 2 of the printing-unit cylinder 1. If resetting elements 17 in the form of springs are provided in the vicinity of the guide bolts 14, the resetting elements 17 move the profile 12 back into the starting position thereof as soon as the pressure in the pressure element 10 has been released.

Figure 2:
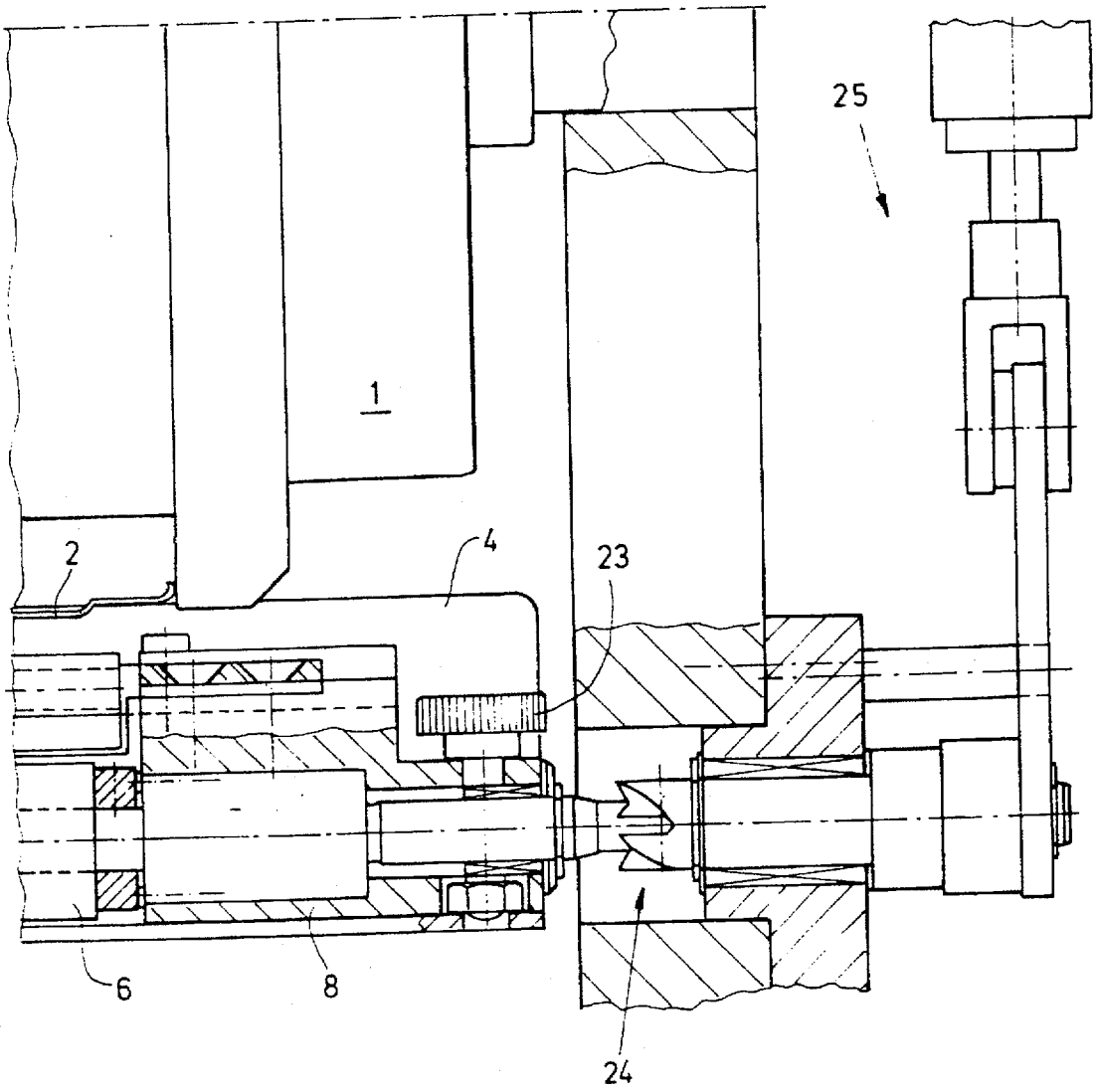

In the half-sectional drive-side view in FIG. 2 of the device according to the invention, the insert 8 is shown likewise connected to the housing 4 by means of a knurled screw 23. In contrast with the operating side of the printing press shown in FIG. 1, a journal pin of the winding coil 6 in FIG. 2 extends through the insert 8 to a coupling 24. A timed or cyclic feed movement generated by a driving device 25 is applied to the winding coil 6 via the coupling 24. The cleaning-cloth web 3 is consequently transported onto the winding coil 6 in timed movements through the intermediary of the coupling 24 until the supply of the cleaning-cloth web 3 originally wound on the supply coil 5 is exhausted.

Figure 3:
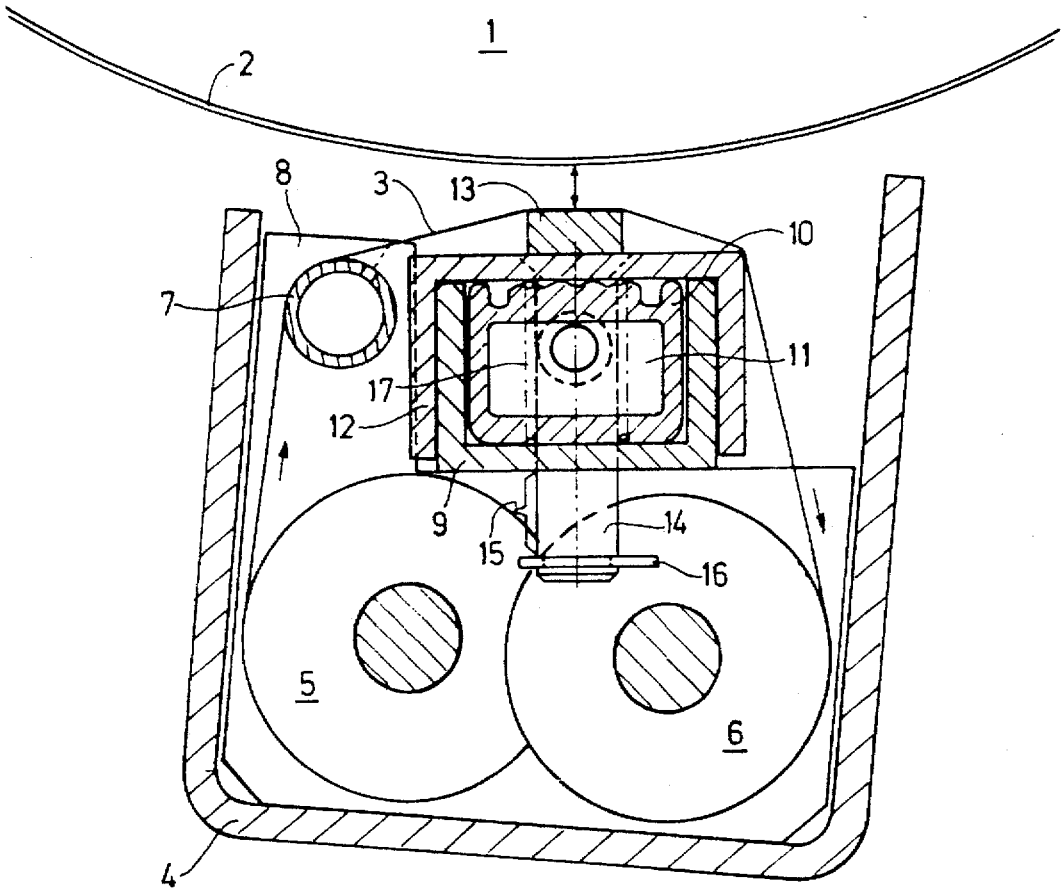
FIG. 3 is an enlarged fragmentary cross-sectional view of FIG. 1 taken along the line III—III in the direction of the arrows and showing the housing and contents of the cleaning device according to the invention.

FIG. 3 is a cross-sectional view of the cleaning-device housing 4 wherein a cleaning-cloth web 3 is shown being transported by means of the two juxtaposed coils 5 and 6 which are journalled in the insert 8 at both sides of the housing 4. A tube 7 is provided for wetting the cleaning-cloth web 3 and, as viewed in the feeding direction of the cleaning-cloth web 3 represented by the associated arrows, is positioned downstream from the supply coil 5.

Attached likewise to the insert 8 is a holder 9, into the U-shaped cross section of which, the pressure element 10 is embedded so as to be enclosed on three sides by the holder 9. The pressure element 10, which is formed as a bellows, for example, is thus able to expand only on one side. The pressure element 10 consequently exerts its maximum pressing force on that one side. Provided above the holder 9 is the profile 12 together with press-on material 13 which are pressed by the press-on element 10 against the outer cylindrical surface 2 of the cylinder 1 which is being cleaned. Because the press-on material 13 is held elastically, it is able to compensate for geometrical and material-related inaccuracies and also to equalize the contact pressure across the format width. The generated contact pressure is sufficient by far to remove solubilized silicone residues and other residues arising from the direct imaging of a printing form completely from the surface of the printing form by the cleaning-cloth web 3. It is obvious that, in addition to the cleaning of the outer cylindrical surface of the printing-unit cylinder 1 of silicone residues, it is also possible for conventional plate cylinders and rubber-blanket cylinders to be cleaned of ink, paper dust and similar residues. In addition to cleaning printing presses with a direct imaging of printing forms, it is, of course, also possible for the device according to the invention to be used to clean rotary printing presses with conventional printing forms. The press-on material 13 on the profile 12 allows a region of a cleaning-cloth web 3 to come into an intimate a real contact with the outer cylindrical surface 2. Because the pressurizable pressure element 10 thus does not come into contact with the cleaning-cloth web 3, the wear thereof is relatively low. Furthermore, the sometimes aggressive components of the cleaning agent are scarcely able to attack the protected pressure element 10, thereby considerably increasing the service life thereof.

Simultaneously with the generation and maintenance of higher contact pressures against the surface being cleaned, due to the defined pressing-force direction in the holder 9, it is also possible for the vertical operating travel 15 to be precisely fixed by the guide bolts 14 together with stops 16. Even in the case of extremely high pressing forces, a possibility of damage to the device due to the dipping of the profile 12 into any cylinder gap on the outer cylindrical surface 2 of the printing-form cylinder 1 is effectively ruled out. Because the pressure element 10 is separated from the press-on material 13, which is not the case, however, in the solutions from the prior art which are outlined herein and necessitates compromises in the selection of suitable materials, it is possible for the press-on material 13 to be selected optimally with regard to pliancy, elasticity and pressure distribution. For example, it is now possible to employ new-type fiber-reinforced plastics which have, however, not been hitherto usable as the pressure element 10 due to a lack of deformability. The separation of the pressure element 10 from the press-on material makes it possible, however, to use respective optimal materials for the respective function, without compromise.

I claim:

1. Device for cleaning a rotating outer cylindrical surface in a printing press, comprising:

a cleaning-cloth web having edges oriented perpendicularly to a direction of generatrices of an outer cylindrical surface;

a cleaning-cloth web supply coil and a winding coil, said cleaning-cloth web being transportable from said supply coil to said winding coil;

a pressure element for pressing a section of said cleaning-cloth web against the outer cylindrical surface to be cleaned;

a holder extending in axial direction of the outer cylindrical surface and embracing said pressure element, said pressure element being disposed parallel to a rotational axis of the outer cylindrical surface; and a profile extending in said axial direction and protectively covering said holder embracing said pressure element for preventing the entry of washing liquids which cause corrosion and wear of said pressure element, said profile being provided with press-on material acting on said cleaning-cloth web from a side thereof opposite to the outer cylindrical surface.

2. Device according to claim 1 wherein said pressure element is enclosed substantially on three sides by said holder.

3. Device according to claim 1, wherein said pressure element is a hollow body pressurizable with a pressure medium.

4. Device according to claim 1, wherein said profile is vertically movable and is guidable at side surfaces thereof by said holder.

5. Device according to claim 1, wherein said profile is rigid.

6. Device according to claim 1, wherein said profile has a guide bolt extending through said holder.

7. Device according to claim 6, wherein said guide bolt extends through said holder beyond a region thereof wherein said pressure element is disposed.

8. Device according to claim 6, including resetting elements provided on said guide bolt between said holder and said profile.

9. Device according to claim 6, wherein said profile is movable along a travel path, and said guide bolt is formed with a stop surface for limiting travel of said profile.

10. Device according to claim 1, wherein said press-on material is an elastic material.

11. Device according to claim 1, wherein said profile and said holder are movable relative to one another when pressure is applied to said pressure element.

12. Device according to claim 1, including a wetting device operatively associated with said cleaning-cloth web upstream from a location at which said press-on material acts upon said cleaning-cloth web, as viewed in a winding direction of said cleaning-cloth web.

13. Device according to claim 1, wherein said profile and said holder are movable relative to one another when pressure is applied to said pressure element for cleaning the surface of a printing-form cylinder.

* * * * *